US007612307B2

(12) United States Patent
Chou et al.

(10) Patent No.: US 7,612,307 B2
(45) Date of Patent: Nov. 3, 2009

(54) LIGHT DIRECTING STRUCTURE FOR INSTRUCTION SWITCHES

(75) Inventors: Chin-Wen Chou, Taipei Hsien (TW); Tsui-Jung Su, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 84 days.

(21) Appl. No.: 11/979,056

(22) Filed: Oct. 30, 2007

(65) Prior Publication Data

US 2009/0107818 A1 Apr. 30, 2009

(51) Int. Cl.
*H01H 9/00* (2006.01)

(52) U.S. Cl. ..... 200/316; 200/314

(58) Field of Classification Search ..... 200/310–317
See application file for complete search history.

(56) References Cited

U.S. PATENT DOCUMENTS 3,560,689 A * 2/1971 Matson ..... 200/314
5,977,901 A * 11/1999 Fenner ..... 341/176
7,091,434 B2 * 8/2006 Suzuki ..... 200/316
2006/0011460 A1 * 1/2006 Hung ..... 200/315

FOREIGN PATENT DOCUMENTS

TW 252616 A 7/1995

* cited by examiner

*Primary Examiner*—Gary F. Paumen
(74) *Attorney, Agent, or Firm*—Muncy, Geissler, Olds & Lowe, PLLC

(57) ABSTRACT

A light directing structure for instruction switches includes an instruction switch, a control element coupled on the perimeter of the instruction switch that is made from a light directing material and has an installation opening to hold the instruction switch, and a circuit board which is electrically connected to the instruction switch and has at least one lighting element to emit light to the control element to enable the control element to generate uniform illumination.

19 Claims, 5 Drawing Sheets

LIGHT DIRECTING STRUCTURE FOR INSTRUCTION SWITCHES

FIELD OF THE INVENTION

The present invention relates to a light directing structure for instruction switches and particularly to a light directing structure that has a lighting element emitting light to a control element to enable the control element to generate uniform illumination.

BACKGROUND OF THE INVENTION

A conventional rotary switch, such as "Rotary switch" disclosed in R.O.C. patent publication No. 252616 includes a case housing a spindle which has an upper end forcefully coupled with a shade turnable under an external force. The bottom end of the spindle is coupled with a conductive element in a compact manner at a desired location, and also is screwed on a base tray at the bottom of the case. The base tray has a plurality of pins and a common pin at selected locations to connect jutting portions at two ends of the conductive element. When in use, such for a fan to control rotation speed, the wire of various rotation speeds (slow speed, medium speed, fast speed and the like) are connected to the pins of the base tray. A power supply end is soldered on the common pin. By turning the shade at the upper end of the spindle, the jutting portions at two ends of the conductive element are driven and moved to connect the pins on the base tray and the common pin, therefore the fan can be activated. By turning the spindle to make the conductive element to connect another pin and the common pin, a desired rotation speed can be selected. However, the conventional rotary switch mentioned above still has flaws, such as the gap between the shade and the spindle is too large and the shade is prone to tilt, and turning could be difficult or faulty instructions could be output. Coupling of the shade and the spindle could also deform or damage the shade or the conductive element. After used for a period of time, the shade could be idly turned under the force and fail to drive the spindle, and could result in erroneous instruction output of the rotary switch.

To overcome the aforesaid drawbacks, another rotary switch has been developed that has a base and a rotary disk coupling with the base and movable on a rotation track relative to the base. A housing space is formed between the base and the rotary disk to hold signal elements. The signal elements output corresponding instructions according to the rotary disk moving on the rotation track. The rotary switch is coupled with a shade which has a latch portion engageable with a latch trough formed on the rotary disk. The shade can be turned under force so such that the latch portion and the latch trough drive the rotary switch to move on the rotation track. By means of such an approach the rotary disk is moved when the shade receives the external force along the rotation track to generate signals. As the rotary disk and the shade are coupled through the latch means, they do easily loosen off or tilted. Thus a firmer coupling between the rotary switch and the shade can be accomplished to generate more accurate instructions.

However, the rotary switches previously discussed cannot be clearly seen and easily turned to the correct position in a dark or poorly lit environment. Faulty operation tends to occur. Hence how to improve the problems mentioned above still is an issue pending to be resolved in the industry.

SUMMARY OF THE INVENTION

The primary object of the present invention is to solve the aforesaid disadvantages. The invention provides a light directing structure for instruction switches that includes an instruction switch, a control element made from a light directing material and coupled on the perimeter of the instruction switch that has an installation opening to hold the instruction switch, and a circuit board electrically connected to the instruction switch that has at least one lighting element to emit light to the control element so that the control element can generate uniform illumination.

The light directing structure according to the invention may also include a control element which is made from light directing material and has an installation opening, a circuit baseboard having a sliding channel corresponding to a sliding rail of the control element to allow the control element to move up and down at a desired distance relative to the circuit baseboard, and a plurality of terminals and a conductive element located between the terminals and the control element to form a plurality of directional instruction switches, and a circuit board electrically connected to a lower side of the circuit baseboard that has at least one lighting element to emit light to the control element so that the control element can generate uniform illumination.

Another object of the invention is to provide a lighting element to emit light to a control element so that the control element can generate uniform illumination to enable users to perform correct operation on an instruction switch in a dark or poorly lit environment.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
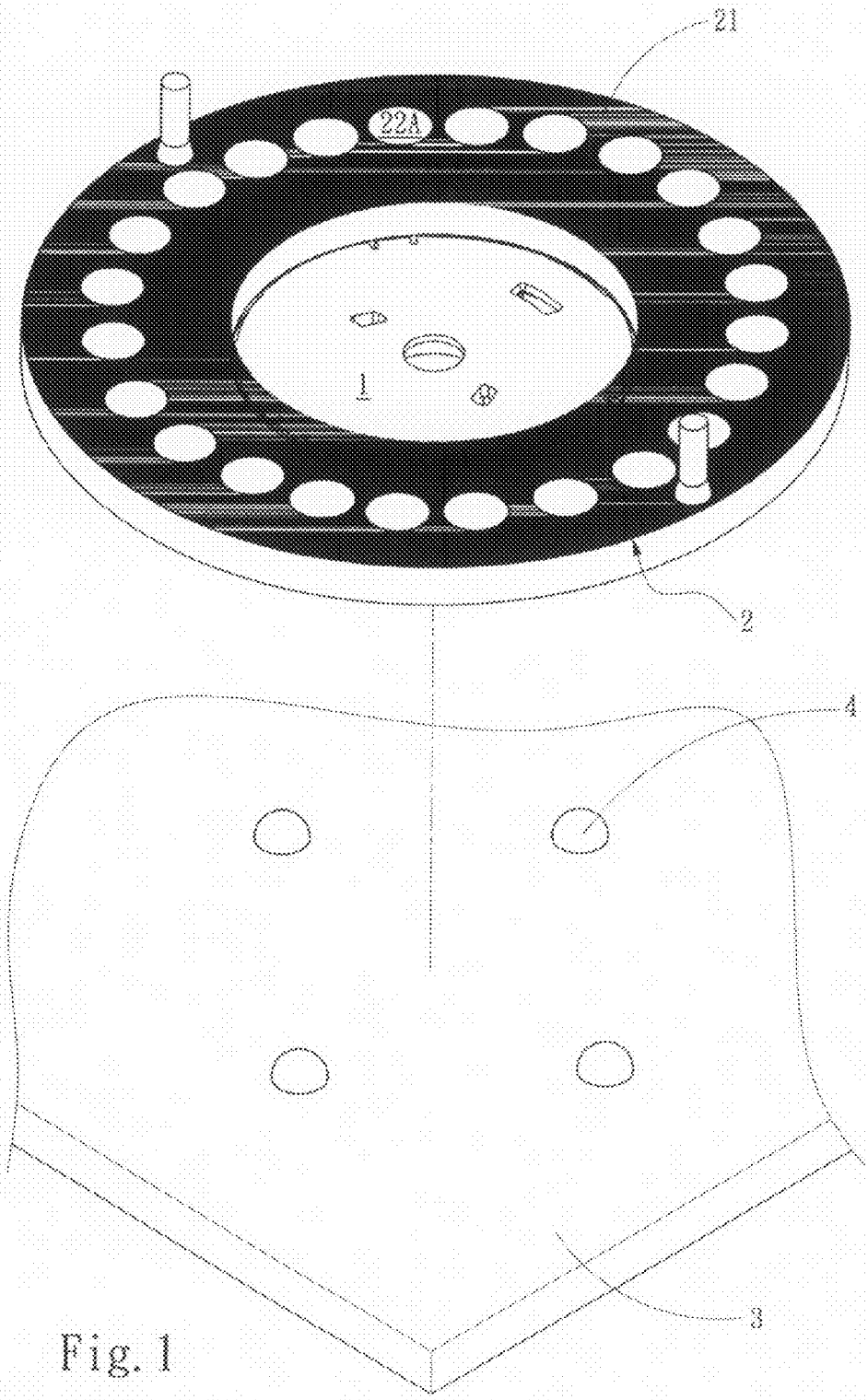
FIG. 1 is an exploded view of a first embodiment of the invention.
Figure 2:
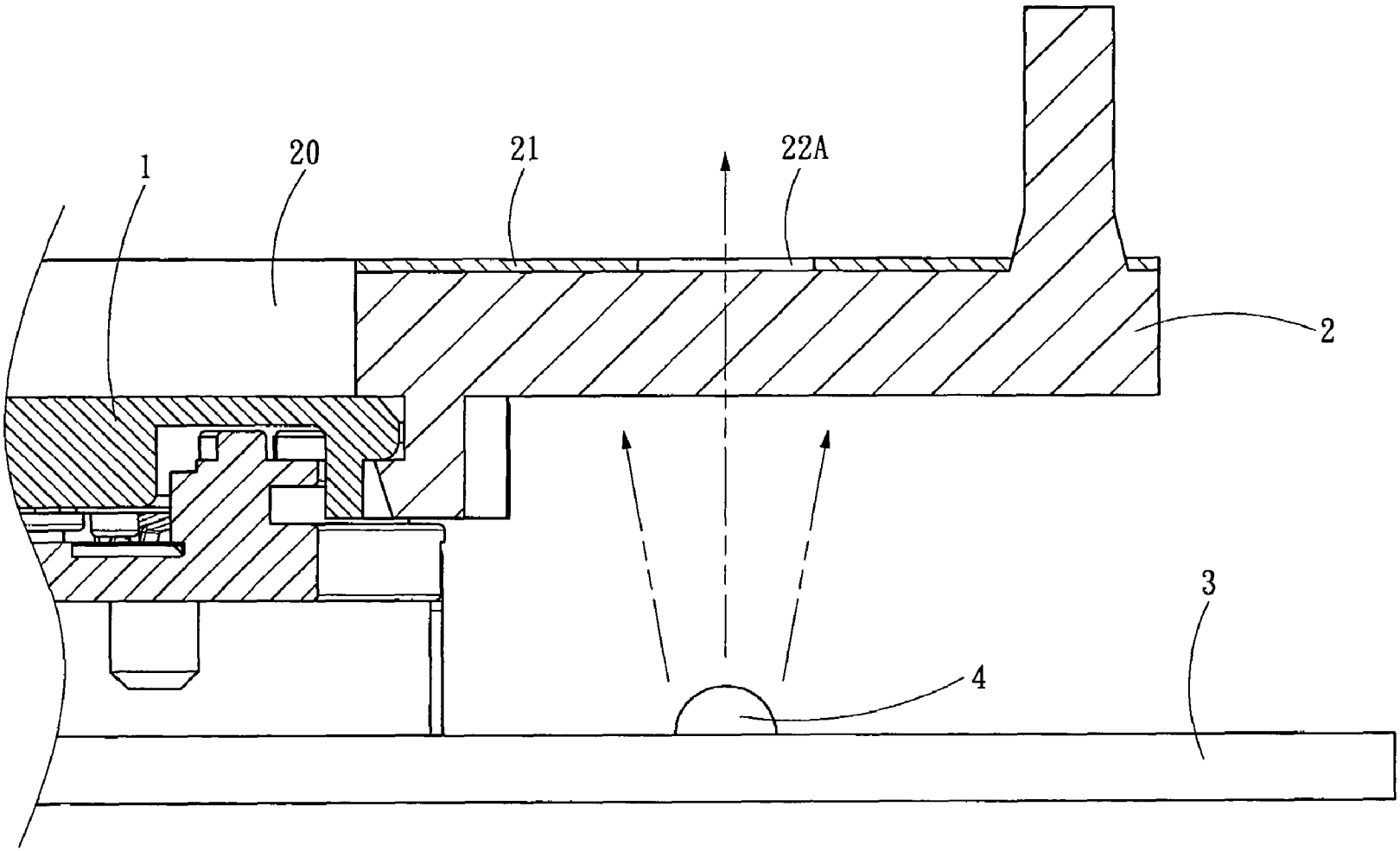
FIG. 2 is a fragmentary sectional view of the first embodiment of the invention.

Please refer to FIGS. 1 and 2 for a first embodiment of the light directing structure for instruction switches of the invention. It includes:

an instruction switch 1 which may be a circular disk rotary switch or a square pushbutton switch. In this embodiment the instruction switch 1 is a circular disk rotary switch;

a control element 2 coupled on the perimeter of the instruction switch 1 that has an installation opening 20 to hold the instruction switch 1. The control element 2 is made from a light directing material. It has a periphery mating the perimeter of the instruction switch 1, and may be circular or square. The control element 2 also is coated with a light masking layer 21 on the surface. The light masking layer is partly embossed to form instruction marks 22A. In this embodiment the control element 2 mates the perimeter of the instruction switch 1, and is formed in an annular shape; and a circuit board 3 which is electrically connected to the instruction switch 1, and has at least one lighting element 4 to emit light to the control element 2 so that the control element 2 can generate uniform illumination. The lighting element 4 may be a light emitting diode (LED), lighting bulb or electro luminescence board. In this embodiment the lighting element 4 is an LED.

By means of the construction set forth above, the surface of the control unit 2 can illuminate light evenly due to light emission from the lighting element 4. Hence the problem of faulty operation in a dark or poorly lit environment occurred to the conventional technique can be overcome.

Figure 3:
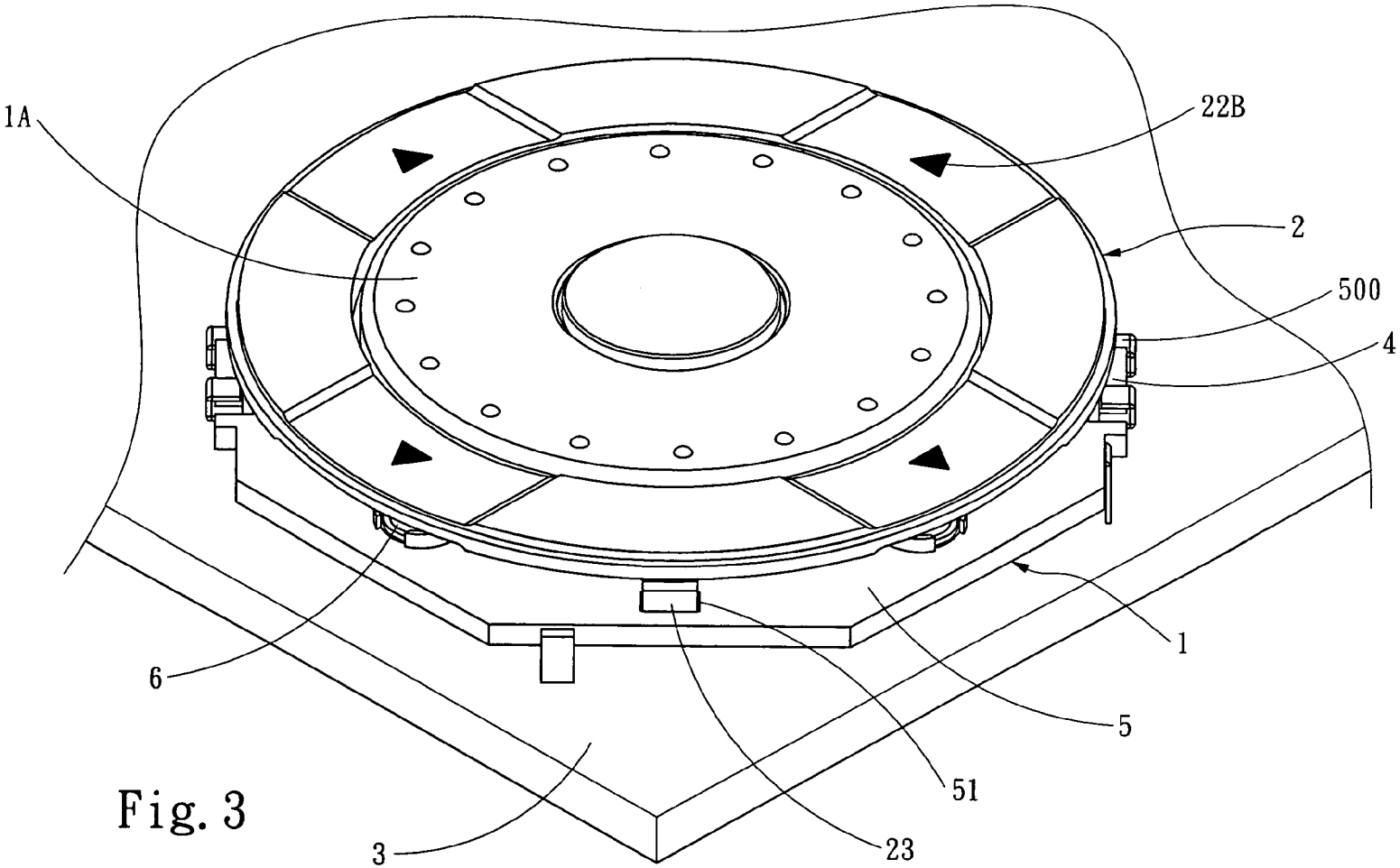
FIG. 3 is a perspective view of a second embodiment of the invention.
Figure 4:
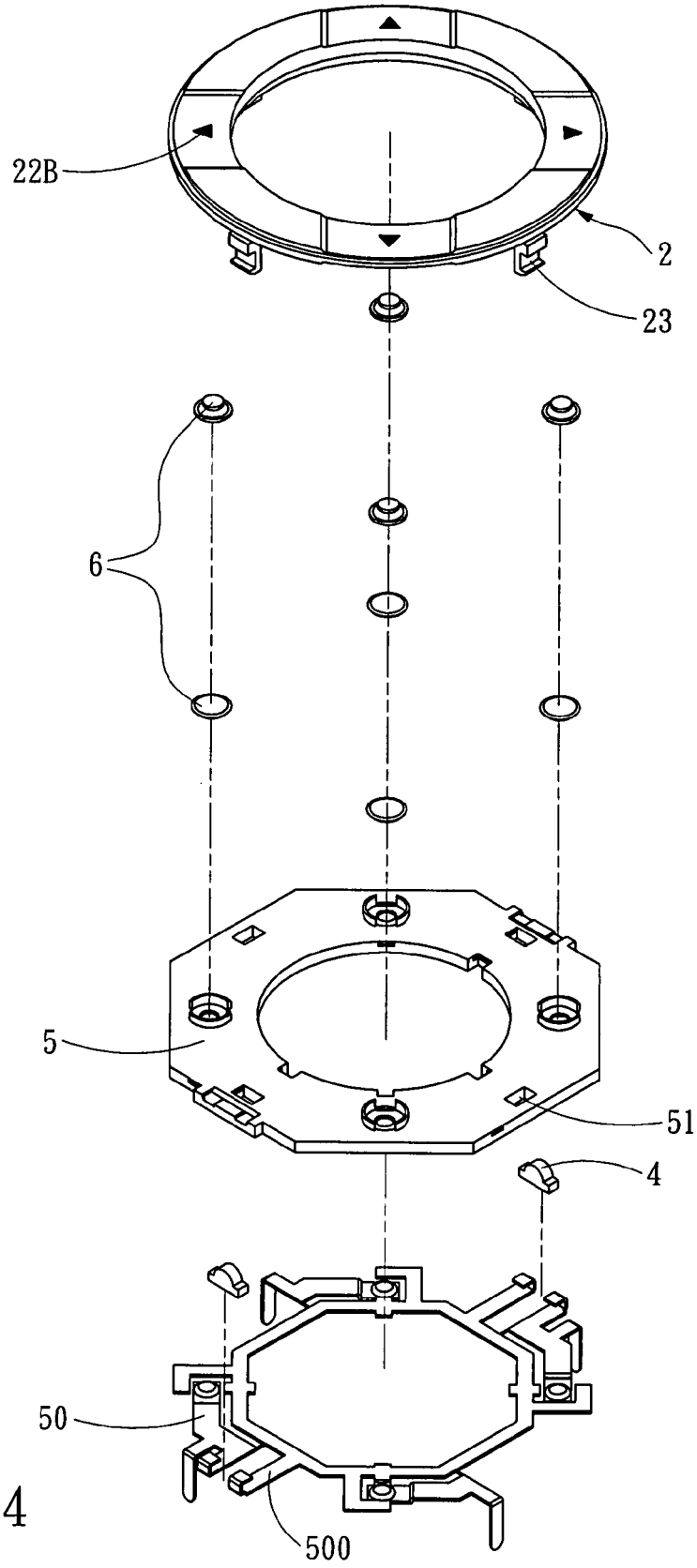
FIG. 4 is an exploded view of the second embodiment of the invention.

Refer to FIGS. 3 and 4 for a second embodiment of the invention. It differs from the first embodiment as follow:

First, the control element 2 and the circuit board 3 are interposed by a circuit baseboard 5 which has a plurality of terminals 50. At least one of the terminals 50 has an extended connecting portion 500.

Second, the terminals 50 located on the circuit board 5 and a conductive element 6 located between the terminals 50 and the control element 2 form a plurality of instruction switches 1. The circuit baseboard 5 and the control element 2 have respectively a sliding rail 23 and a sliding channel 51 corresponding to each other to allow the control element 2 to be moved up and down relative to the circuit baseboard 5 for a selected distance.

Third, the lighting element 4 is connected to the connecting portion 500.

Fourth, the instruction marks 22B are an opaque layer printed on the surface of the control element 2.

Fifth, the installation opening 20 holds a circular disk rotary switch 1A so that users can operate the circular disk rotary switch 1A and the directional instruction switch 1 at the same time to increase operational flexibility and versatility of executing instructions.

Figure 5:
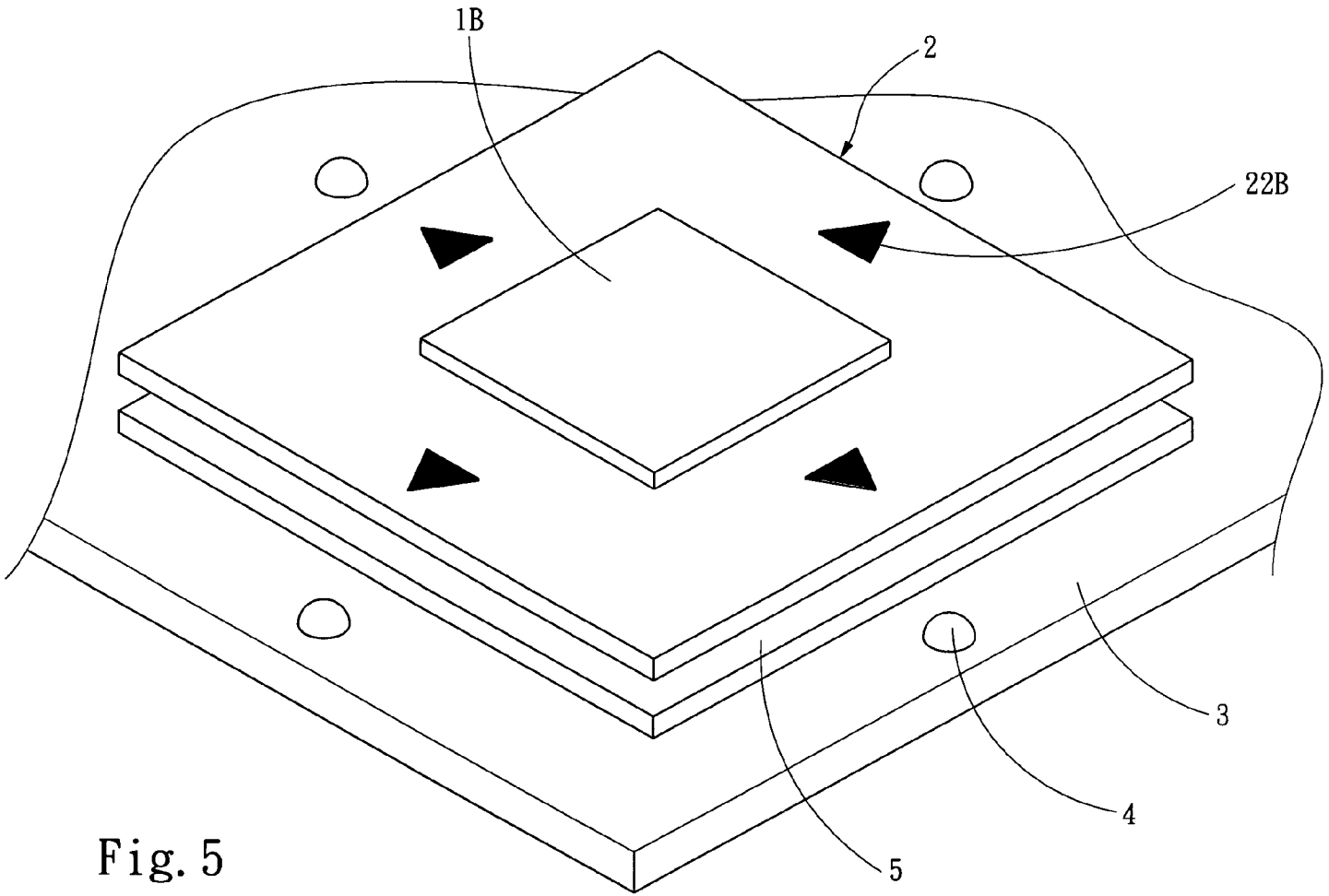
FIG. 5 is a perspective view of a third embodiment of the invention.

Refer to FIG. 5 for a third embodiment of the invention. It differs from the second embodiment by holding a square pushbutton switch 1B in the installation opening 20. The control element 2 and the circuit baseboard 1B also are formed in a square.

By means of the embodiments set forth above, the surface of the control element 2 can generate uniform illumination resulting from light emission from the lighting element 4. Therefore faulty operation that might otherwise occur in a dark or properly lit embodiment can be prevented. Other types of switches may also be adopted besides the circular disk rotary switch 1A and square pushbutton switch 1B. And more flexible and versatile operations can be provided to users to easily execute instructions. It offers a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A light directing structure for instruction switches, comprising:

an instruction switch;

a control element which is made from a light directing material and coupled on the perimeter of the instruction switch and has an installation opening to hold the instruction switch; and a circuit board which is electrically connected to the instruction switch and has at least one lighting element to emit light to the control element to generate uniform illumination.

2. The light directing structure of claim 1, wherein the lighting element is a light emitting diode.

3. The light directing structure of claim 1, wherein the lighting element is a lighting bulb.

4. The light directing structure of claim 1, wherein the lighting element is an electro luminescence plate.

5. The light directing structure of claim 1, wherein the control element is coated with a light masking layer on the surface thereof that is partly embossed to form instruction marks.

6. The light directing structure of claim 1, wherein the control element is printed with opaque instruction marks on the surface thereof.

7. The light directing structure of claim 1, wherein the control element and the circuit board are interposed by a circuit baseboard which has a plurality of terminals and a conductive element located between the terminals and the control element to form a plurality of directional instruction switches.

8. The light directing structure of claim 7, wherein at least one of the terminals is extended to form a connecting portion to be connected to the lighting element.

9. The light directing structure of claim 1, wherein the instruction switch is a circular disk rotary switch and the control element is annular.

10. The light directing structure of claim 1, wherein the instruction switch is a square pushbutton switch and the control element is square.

11. A light directing structure for instruction switches, comprising:

a control element which is made from a light directing material and has an installation opening;

a circuit baseboard which has a sliding channel corresponding to a sliding rail formed on the control element to allow the control element to be moved up and down relative to the circuit baseboard for a selected distance, and a plurality of terminals and a conductive element located between the terminals and the control element to form a plurality of directional instruction switches; and a circuit board which is electrically connected to a lower side of the circuit baseboard and has at least one lighting element to emit light to the control element to generate uniform illumination.

12. The light directing structure of claim 11, wherein the lighting element is a light emitting diode.

13. The light directing structure of claim 11, wherein the lighting element is a lighting bulb.

14. The light directing structure of claim 11, wherein the lighting element is an electro luminescence plate.

15. The light directing structure of claim 11, wherein the control element is coated with a light masking layer on the surface thereof that is partly embossed to form instruction marks.

16. The light directing structure of claim 11, wherein the control element is printed with opaque instruction marks on the surface thereof.

17. The light directing structure of claim 11, wherein at least one of the terminals is extended to form a connecting portion to be connected to the lighting element.

18. The light directing structure of claim 11, wherein the control element is annular.

19. The light directing structure of claim 11, wherein the control element is square.

* * * * *